US009322204B2

(12) United States Patent
Suzuki

(10) Patent No.: US 9,322,204 B2
(45) Date of Patent: Apr. 26, 2016

(54) DOOR ACTUATING APPARATUS

(71) Applicant: AISIN SEIKI KABUSHIKI KAISHA, Kariya-shi (JP)

(72) Inventor: Shintaro Suzuki, Kasugai (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 223 days.

(21) Appl. No.: 14/067,217

(22) Filed: Oct. 30, 2013

(65) Prior Publication Data

US 2014/0137474 A1 May 22, 2014

(30) Foreign Application Priority Data

Nov. 20, 2012 (JP) ..... 2012-254380

(51) Int. Cl.
*E05C 3/06* (2006.01)
*E05C 3/16* (2006.01)
(Continued)

(52) U.S. Cl.
CPC ..... *E05F 15/18* (2013.01); *E05B 81/06* (2013.01); *E05B 81/14* (2013.01); *E05B 81/20* (2013.01); *E05B 81/36* (2013.01); *E05B 81/66* (2013.01); *E05B 81/70* (2013.01); *E05B 85/02* (2013.01); *E05C 17/203* (2013.01); *E05F 15/00* (2013.01);
(Continued)

(58) Field of Classification Search
CPC ..... Y10T 16/61; Y10T 16/27; Y10T 16/6295; Y10T 292/71; Y10T 292/096; Y10T 292/1047; E05B 81/20; E05B 77/00; E05F 1/002; E05F 15/611; E05F 15/00; E05C 17/206
USPC ..... 292/DIG. 15, 201, 210, 216, 200, 198, 292/DIG. 23; 16/82, 85, 86 A, 86 C; 49/324, 49/345, 356, 358; 296/146.4, 146.8
See application file for complete search history.

(56) References Cited

U.S. PATENT DOCUMENTS 3,012,269 A * 12/1961 Bartel ..... E05C 17/206 16/86 A
5,152,030 A * 10/1992 Cogo ..... E05C 17/206 16/344
(Continued)

FOREIGN PATENT DOCUMENTS

JP 2005-232752 A 9/2005
JP 4389899 B2 12/2009
JP EP 2733292 A2 * 5/2014 ..... E05F 15/611

*Primary Examiner* — Kristina Fulton
*Assistant Examiner* — Faria Ahmad
(74) *Attorney, Agent, or Firm* — Buchanan Ingersoll & Rooney PC

(57) ABSTRACT

A door actuating apparatus includes an engagement mechanism configured to retain a door at a full close position, an operating portion configured to output a signal to open the door, a control unit actuating an actuator by receiving the signal, an engagement member advancing and retracting relative to the door in accordance with rotation of the door, and a door opening mechanism operating by actuation of the actuator, positioning the door at a full close position to a predetermined rotational position by rotating the door in a vehicle exterior direction by biasing the engagement member by engaging with the engagement member when the door is released from an engaged state by the door opening mechanism engaging with the engagement mechanism, and releasing engagement with the engagement member when an external force rotating the door in the vehicle exterior direction is exerted on the door at the predetermined rotational position.

11 Claims, 10 Drawing Sheets

(51) Int. Cl.

| | |
|---|---|
| ***E05F 15/18*** | (2006.01) |
| ***E05C 17/20*** | (2006.01) |
| ***E05F 15/00*** | (2015.01) |
| ***E05B 81/06*** | (2014.01) |
| ***E05B 81/14*** | (2014.01) |
| ***E05B 81/20*** | (2014.01) |
| ***E05B 81/36*** | (2014.01) |
| ***E05B 81/66*** | (2014.01) |
| ***E05B 81/70*** | (2014.01) |
| ***E05B 85/02*** | (2014.01) |
| ***E05F 15/611*** | (2015.01) |
| ***E05F 15/616*** | (2015.01) |
| *E05F 5/02* | (2006.01) |
| *E05F 11/00* | (2006.01) |
| *E05C 17/22* | (2006.01) |
| *B60J 5/00* | (2006.01) |
| *E05B 83/36* | (2014.01) |

(52) U.S. Cl.

CPC ..... *E05F 15/611* (2015.01); *E05F 15/616* (2015.01); *E05B 83/36* (2013.01); *E05Y 2201/686* (2013.01); *E05Y 2900/531* (2013.01); *Y10S 292/15* (2013.01)

(56) References Cited

U.S. PATENT DOCUMENTS 5,497,641 A * 3/1996 Linde ..... E05B 81/14 180/289
5,862,570 A * 1/1999 Lezuch ..... E05C 17/085 16/82
6,065,316 A * 5/2000 Sato ..... E05B 81/06 292/201
6,370,732 B1 * 4/2002 Yezersky ..... E05C 17/203 16/82
6,382,706 B2 * 5/2002 Yuge ..... 296/106
6,446,305 B1 * 9/2002 Kneeland ..... E05C 17/206 16/49
6,513,859 B2 * 2/2003 Yuge ..... E05F 15/619 296/146.4
6,575,003 B1 * 6/2003 Dupont ..... E05B 81/14 292/201
6,584,642 B2 * 7/2003 Hodson ..... E05F 5/08 16/85
6,711,778 B2 * 3/2004 Sparkman ..... E05C 17/203 16/82
6,966,600 B2 * 11/2005 Moriyama ..... B60J 5/0479 16/82
6,979,046 B2 * 12/2005 Moriyama ..... B60J 5/0479 16/366
7,076,833 B2 * 7/2006 Murayama ..... E05C 17/203 16/82
7,145,436 B2 * 12/2006 Ichikawa ..... E05B 85/01 340/5.72
7,500,711 B1 * 3/2009 Ewing ..... E05F 15/622 296/146.1
7,614,670 B2 * 11/2009 Hayakawa ..... E05B 81/20 292/201
7,644,976 B2 * 1/2010 Suzuki ..... B60J 5/0497 292/216
7,703,816 B2 * 4/2010 Kitayama ..... E05C 17/203 16/86 A
7,870,643 B2 * 1/2011 Krueger ..... E05F 1/1066 16/282
8,366,175 B2 * 2/2013 Schmitt ..... E05C 17/006 16/86 B
8,414,062 B2 * 4/2013 Gobart ..... E05D 11/1028 16/82
8,429,793 B2 * 4/2013 Heinrichs ..... E05C 17/203 16/76
8,499,416 B2 * 8/2013 Settsu ..... E05F 5/025 16/86 B
8,733,818 B2 * 5/2014 Hooton ..... E05C 17/203 16/86 C
8,869,350 B2 * 10/2014 Gruber ..... 16/82
2003/0037411 A1 * 2/2003 Seo ..... E05C 17/206 16/86 C
2004/0004357 A1 * 1/2004 Arlt ..... E05B 81/06 292/201
2004/0046400 A1 * 3/2004 Drysdale ..... E05B 77/06 292/216
2004/0090083 A1 * 5/2004 Greuel ..... E05F 15/70 296/146.4
2004/0111832 A1 * 6/2004 Murayama ..... E05C 17/203 16/82
2004/0227357 A1 * 11/2004 Ishihara ..... E05B 81/20 292/216
2004/0244683 A1 * 12/2004 Beckord ..... B05B 13/0292 118/500
2004/0251696 A1 * 12/2004 Murayama ..... E05C 17/203 292/262
2004/0262928 A1 * 12/2004 Fukunaga ..... E05B 79/04 292/216
2005/0104383 A1 * 5/2005 Ottino ..... B60J 5/0416 292/216
2005/0121921 A1 * 6/2005 Alguera ..... B62D 53/10 292/201
2005/0127711 A1 * 6/2005 Rigorth ..... E05F 15/63 296/146.4
2005/0179265 A1 * 8/2005 Bendel ..... E05B 77/02 292/216
2005/0236847 A1 * 10/2005 Taniyama ..... E05B 81/06 292/216
2006/0006672 A1 * 1/2006 Fujihara ..... E05B 83/38 292/216
2006/0059657 A1 * 3/2006 Heinrichs ..... E05C 17/203 16/85
2006/0150367 A1 * 7/2006 Matsuki ..... E05C 17/206 16/86 C
2006/0207059 A1 * 9/2006 Van Den Heuvel ... E05C 17/203 16/86 B
2007/0040392 A1 * 2/2007 Matsuki ..... E05C 17/206 292/262
2007/0063536 A1 * 3/2007 Okada ..... E05F 15/619 296/146.4
2007/0120378 A1 * 5/2007 Hayakawa ..... E05B 81/20 292/216
2007/0138802 A1 * 6/2007 Stasko ..... E05B 81/14 292/201
2007/0290796 A1 12/2007 Teshima et al.
2008/0022736 A1 * 1/2008 Kouzuma ..... E05B 81/20 70/237
2008/0066260 A1 * 3/2008 Clark ..... E05C 17/203 16/86 A
2008/0209811 A1 * 9/2008 Bienek ..... E05F 3/104 49/139
2008/0271286 A1 * 11/2008 Stalhammar ..... E05C 17/203 16/84
2009/0217596 A1 * 9/2009 Neundorf ..... E05B 81/20 49/506
2010/0026014 A1 2/2010 Machida et al.
2011/0140461 A1 * 6/2011 Murray ..... B62D 33/0273 292/137
2011/0266080 A1 * 11/2011 Schmitt ..... E05C 17/006 180/89.1
2012/0233813 A1 * 9/2012 Settsu ..... E05F 5/00 16/82
2012/0291354 A1 * 11/2012 Giannis ..... E05F 15/63 49/324
2013/0031747 A1 * 2/2013 Gobart ..... E05D 11/1028 16/82
2013/0036673 A1 * 2/2013 Wassenaar ..... B60J 5/0498 49/324
2013/0091772 A1 * 4/2013 Berger ..... E05F 15/60 49/324
2014/0041154 A1 * 2/2014 Kamata ..... E05F 5/06 16/82
2014/0053370 A1 * 2/2014 Tseng ..... E05C 17/203 16/82

(56) References Cited

U.S. PATENT DOCUMENTS

2014/0059802 A1* 3/2014 Matsuki ..... E05F 5/025
16/82
2014/0070549 A1* 3/2014 Hanaki ..... E05B 81/06
292/200
2014/0110952 A1* 4/2014 Lange ..... E05B 81/76
292/129
2014/0318023 A1* 10/2014 Costigan ..... E05F 5/06
49/501
2014/0352216 A1* 12/2014 Kapustnyk ..... E05B 81/06
49/31

* cited by examiner

DOOR ACTUATING APPARATUS

CROSS REFERENCE TO RELATED APPLICATIONS

This application is based on and claims priority under 35 U.S.C. §119 to Japanese Patent Application 2012-254380, filed on Nov. 20, 2012, the entire content of which is incorporated herein by reference.

TECHNICAL FIELD

This disclosure generally relates to a door actuating apparatus.

BACKGROUND DISCUSSION

In general, a vehicle includes a latch apparatus that retains a door at a full close position. A door handle arranged on a door connects to the latch apparatus. In order to open the door that is at the full close position, the door handle is held and pulled strongly to release the door from being retained at the full close position by the latch apparatus. More specifically, a particularly large operational force is required in the beginning at a time of opening the door.

A vehicle including a door actuating apparatus for automatically opening and closing a door that is rotatably supported by a vehicle body is disclosed in JP2005-232752A, hereinafter referred to as Reference 1. The door actuating apparatus disclosed in Reference 1 includes a rod formed in an elongated form and a driving mechanism driving the rod. One end of the rod is retained by the vehicle body to be rotatable. The other end of the rod is retained by a retaining member arranged inside the door such that the rod is configured to advance and retract relative to the door. The driving mechanism is mounted inside the door. The driving mechanism includes an electric motor and a power transmission mechanism. The power transmission mechanism converts rotational movement of the electric motor into linear movement and transmits power from the electric motor to the rod. The power transmission mechanism includes, for example, a worm gear mounted on a driving shaft of the electric motor, a worm wheel meshing with the worm gear, a reducer formed by a multiple number of gears rotating in accordance with rotation of the worm wheel, and a rack gear meshing with one of a multiple number of gears forming the reducer. The other end of the rod is mounted on the rack gear. In addition, an electromagnetic clutch is arranged between the worm wheel and the reducer. A switch for operating the door to open and to close is provided on a portable device or a on a vehicle. The electric motor is actuated when the switch is operated. When the electric motor is actuated in a state where the electromagnetic clutch is connected, driving power of the electric motor is transmitted to the rod. As a result, the door automatically rotates between a full close position and a full open position. In a state where the electromagnetic clutch is connected and the electric motor is not actuated, the door does not move. More specifically, the door is restrained from rotating from a stopped position because the worm gear restrains rotation of the worm wheel. Accordingly, a user may not be able to manually open and close the door. In a state where the electromagnetic clutch is disconnected, rotations of the gears forming the reducer are not transmitted to the worm wheel so that the user may manually open and close the door. Accordingly, the door actuating apparatus according to Reference 1 may open and close the door without difficulty by a simple operation of an operation button. In addition, the door may be manually opened and closed by setting the electromagnetic clutch in a disconnected state.

Nevertheless, the door actuating apparatus according to Reference 1 requires actuation of the electric motor in addition to actuation of the electromagnetic clutch. Accordingly, a drive circuit, for example, a power source circuit, for actuating each of the electric motor and the electromagnetic clutch becomes large in size. In addition, each of the electromagnetic clutch and the electric motor requires separate control. Computer hardware and software configurations of a control apparatus become complex in order to control each of the electromagnetic clutch and the electric motor. Accordingly, a large number of components may be required and cost may increase.

A need thus exists for a door actuating apparatus, which is not susceptible to the drawbacks mentioned above.

SUMMARY

A door actuating apparatus includes an engagement mechanism selectively achieving an engaged state and a disengaged state, the engagement mechanism configured to achieve the engaged state where a door that is rotatably supported by a vehicle body is retained at a full close position, the engagement mechanism configured to achieve the disengaged state where the door is not retained at the full close position, an operating portion configured to be operated for rotating the door that is at the full close position outward relative to a vehicle interior, the operating portion outputting a signal for rotating the door, a control unit receiving the signal from the operating portion, the control unit actuating an actuator in response to the signal, an engagement member configured to be retained by the vehicle body and configured to engage with the door, the engagement member advancing and retracting relative to the door in accordance with rotation of the door, and a door opening mechanism operating by actuation of the actuator, the door opening mechanism shifting a state of the engagement mechanism from the engaged state to the disengaged state by engaging with the engagement mechanism that is in the engaged state, the door opening mechanism engaging with the engagement member configured to rotate the door from the full close position to a predetermined rotational position positioned between the full close position and a full open position, the door opening mechanism separating from the engagement member configured to allow the door to rotate in a vehicle exterior direction relative to a rotational position of the door corresponding to an operational position of the door opening mechanism in a state where an external force rotating the door in the vehicle exterior direction is exerted on the door in a case where the engagement mechanism is in the disengaged state.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
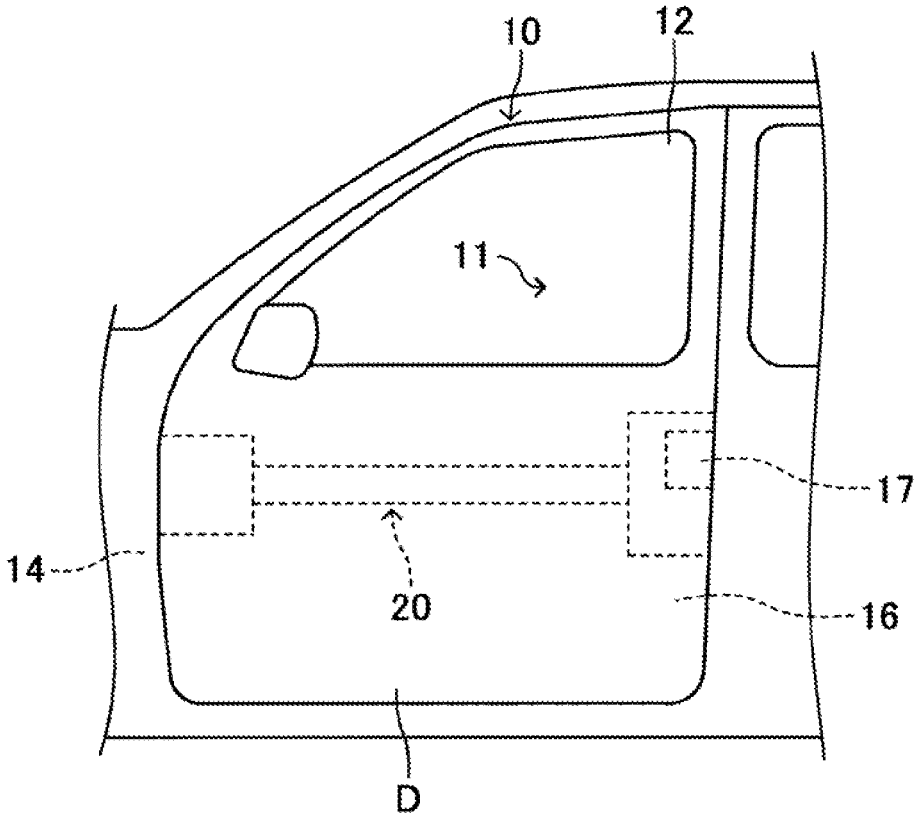
FIG. 1 is a schematic drawing illustrating a door of a vehicle where a door actuating apparatus according to an embodiment is mounted.
Figure 2:
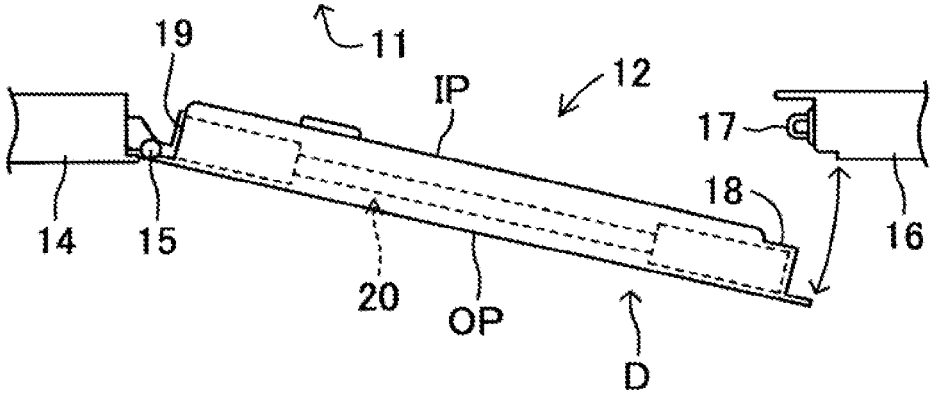
FIG. 2 is a top view drawing illustrating the door in FIG. 1.

A door actuating apparatus 20 according to an embodiment will be described. First, a structure of a door 10, which is where the door actuating apparatus 20 is to be mounted, will be described. As FIGS. 1 and 2 illustrate, the door 10 includes a door body D formed by bonding an outer panel OP arranged at a position in an exterior direction relative to a vehicle interior 11 and an inner panel IP arranged at a position in an interior direction relative to the vehicle interior 11. A void is formed between the outer panel OP and the inner panel IP. The door actuating apparatus 20 is arranged in the void, which is an internal portion of the door body D. The door 10 is mounted on a frontward pillar 14 via a hinge 15. The frontward pillar 14 is a structure forming a frontward side surface of a door opening portion 12. The door opening portion 12 is formed at a side portion of the vehicle interior 11. The door 10 rotates about a rotational axis of the hinge 15 to open and close the door opening portion 12. On a center pillar 16 forming a rearward side surface of the door opening portion 12, a striker 17 is mounted. The striker 17 engages with a latch 32 forming a latch mechanism 30, which will be described later. An opening 18 is formed at a rearward end portion of the door body D. In a state where the door 10 is operated to close, the striker 17 enters the door body D through the opening 18.

Figure 3:
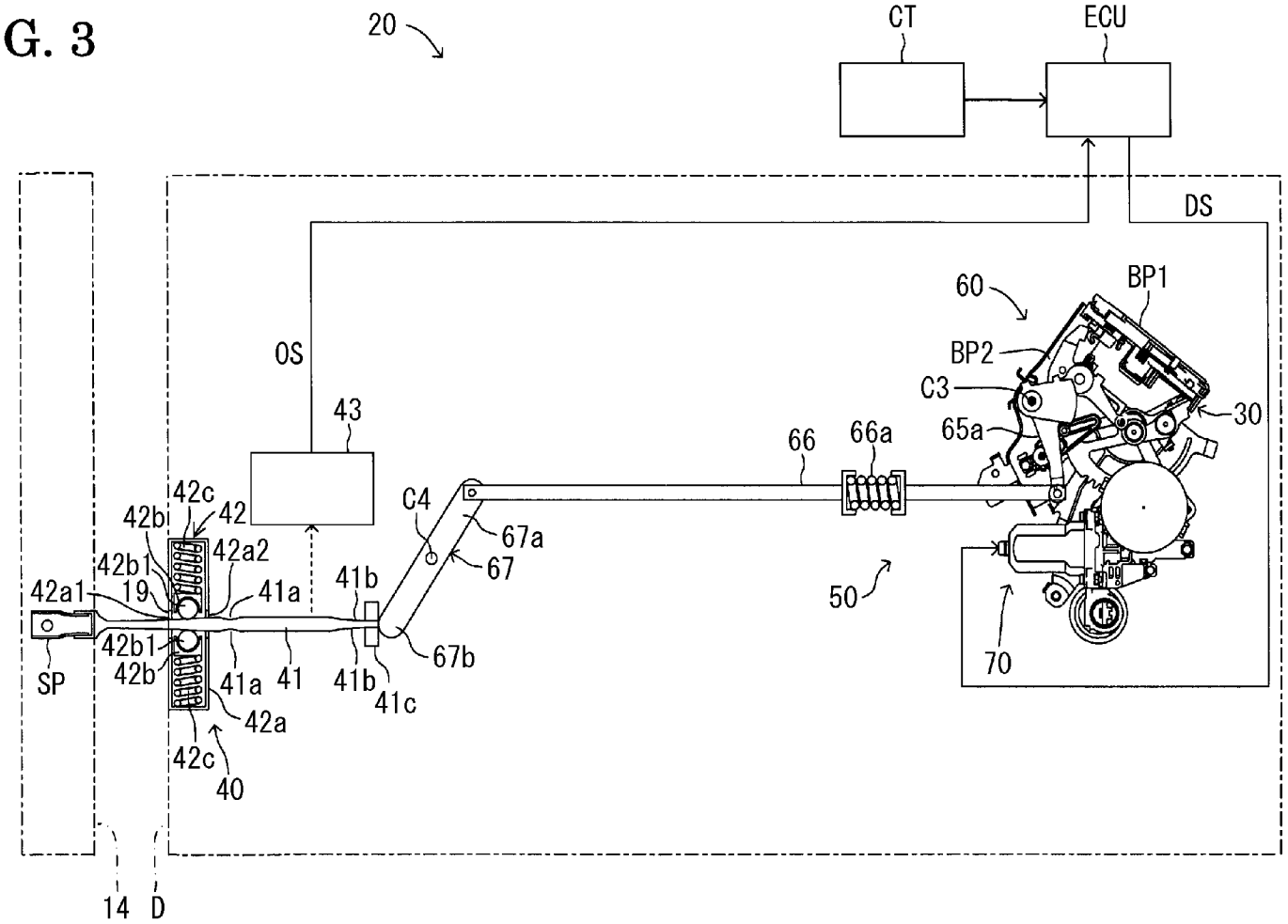
FIG. 3 is a schematic drawing illustrating the door actuating apparatus in FIG. 1.

As FIG. 3 illustrates, the door actuating apparatus 20 includes a control portion ECU serving as a control unit including a microcomputer, an operating portion CT operated to open the door 10, the latch mechanism 30 serving as an engagement mechanism retaining the door 10 in a closed state, a door check mechanism 40 retaining the door 10 at a predetermined rotational position, and a driving portion 50 actuating the door 10. Note that, the door check mechanism 40 and the driving portion 50 serve as a door opening mechanism.

The control portion ECU further includes a power source circuit controlling supply of electric power to an electric motor 71, which will be described later. An example of the operating portion CT is a push button type switch and a touch type switch arranged on a portable device or on the door 10. An example of the portable device is a key. The operating portion CT connects to the control portion ECU so that the control portion ECU detects operation of the operating portion CT.

Figure 4:
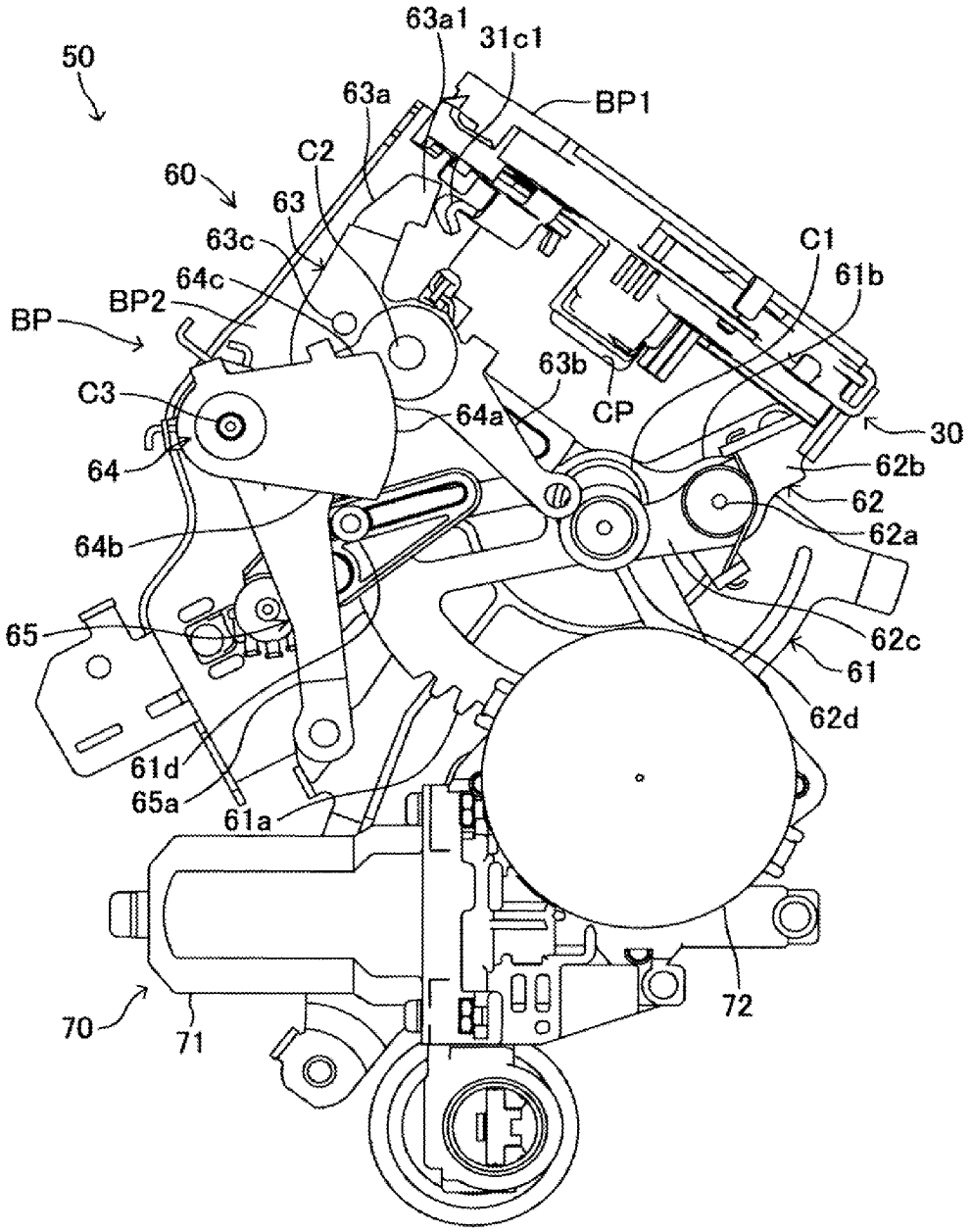
FIG. 4 is an enlarged view drawing illustrating major parts of a driving portion illustrated in FIG. 3 being enlarged.

As FIG. 4 illustrates, a base panel BP retains major components forming the latch mechanism 30 and the driving portion 50. The base panel BP is mounted on a retaining member arranged at the rearward end portion inside the door body D. The base panel BP includes a first retaining portion BP1 and a second retaining portion BP2. Each of the first retaining portion BP1 and the second retaining portion BP2 is formed in substantially a plate form. In a state where the base panel BP is mounted on the door body D, the first retaining portion BP1 is tilted such that an upper end portion of the first retaining portion BP1 is positioned at a position in a frontward direction relative to a lower end portion of the first retaining portion BP1. Furthermore, the second retaining portion BP2 is arranged to extend in a frontward-downward direction at an end portion of the first retaining portion BP1 in a vehicle interior direction. On the base panel BP, a striker receiving recess CP is formed by cutting out a portion of the base panel BP, the portion spanning from a rearward end portion of the first retaining portion BP1 to an end portion of the second retaining portion BP2 in the vehicle interior direction. In a state where the door 10 is closed, the striker 17 enters inside the door body D through the opening 18 and enters inside the striker receiving recess CP.

Figure 5:
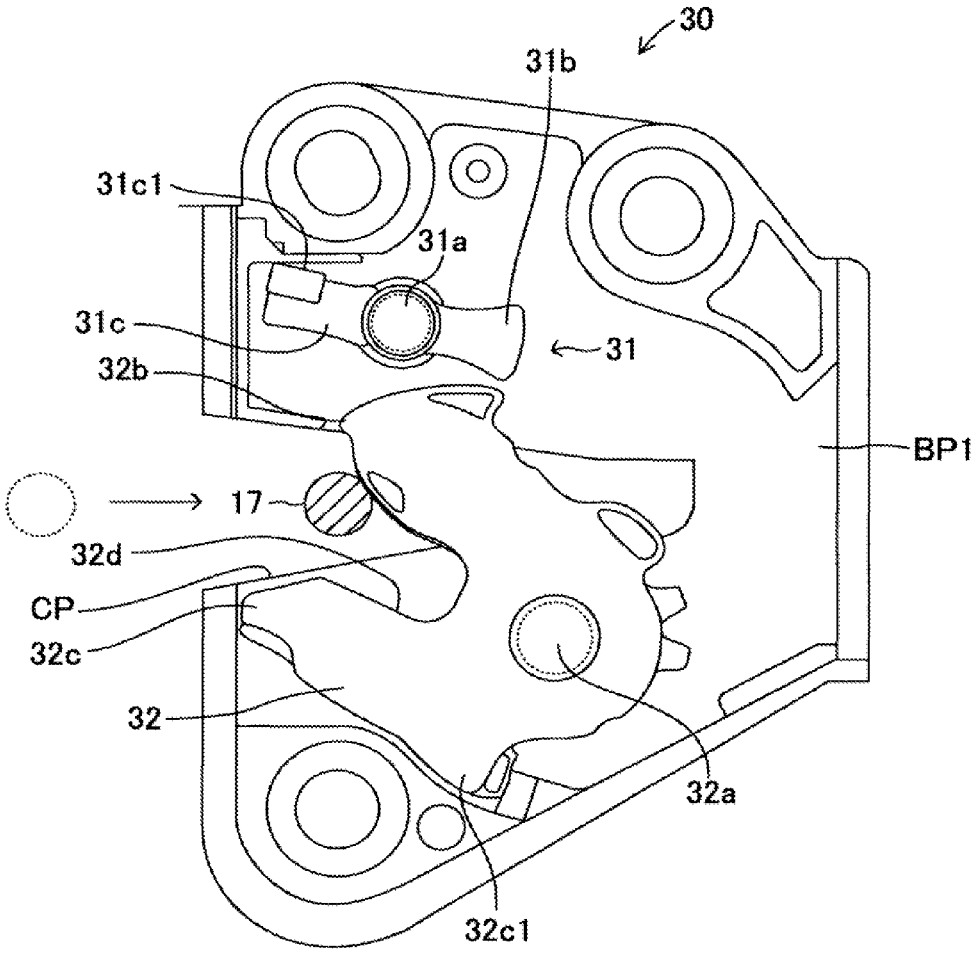
FIG. 5 is an enlarged view drawing illustrating a latch mechanism viewed from frontward in a state where the door is released from being retained.

As FIG. 5 illustrates, the latch mechanism 30 includes a pole 31 and the latch 32. The pole 31 is pivotally supported by the first retaining portion BP1 to be rotatable at a position in an upward direction in FIG. 5 relative to the striker receiving recess CP. The pole 31 includes a latch locking portion 31*b* extending toward right in FIG. 5 from a rotational shaft 31*a* of the pole 31 and a stopper portion 31*c* extending toward left in FIG. 5 from the rotational shaft 31*a*. A torsion coil spring is arranged between the pole 31 and the first retaining portion BP1. The torsion coil spring biases the pole 31 in a clockwise direction in FIG. 5, which is a restraining direction of the pole 31. The pole 31 is positioned at a lock position when the stopper portion 31*c* makes contact with the first retaining portion BP1. The stopper portion 31*c* is formed with a portion to be pushed downward 31*c*1, which serves as an engaging portion. The portion to be pushed downward 31*c*1 is formed by folding an end portion of the stopper portion 31*c* in FIG. 5 toward a surface where FIG. 5 is drawn. The portion to be pushed downward 31*c*1 is positioned at a position in a downward direction relative to a pushing down portion 63*a*1, as FIG. 4 illustrates, so that the portion to be pushed downward 31*c*1 may be pushed downward by the pushing down portion 63*a*1 of an open lever 63, which will be described later.

The latch 32 is pivotally supported by the first retaining portion BP1 to be rotatable at a position in a downward direction in FIG. 5 relative to the striker receiving recess CP. The latch 32 includes a half-latch projection 32*b* and a full-latch projection 32*c*, each of which projects radially outward from a rotational shaft 32*a* of the latch 32. The half-latch projection 32*b* and the full-latch projection 32*c* extend substantially parallel to each other in a same direction. A recess 32*d* is formed between the half-latch projection 32*b* and the full-latch projection 32*c*. A torsion coil spring is arranged between the latch 32 and the first retaining portion BP1 to bias the latch 32 in a counterclockwise direction in FIG. 5, which is a release direction of the latch 32. In a state where the door 10 is open, a stopper formed on the latch 32 is in contact with the first retaining portion BP1 so that the latch 32 is positioned at a predetermined position, which is an unlatch position of the latch 32, shown in FIG. 5.

In a case where the door 10 is closed from a state where the door 10 is open, the striker 17 enters the striker receiving recess CP. In addition, the striker 17 enters inside the recess 32*d* formed on the latch 32. When the striker 17 makes contact with a side wall of the recess 32*d*, the striker 17 pushes the latch 32 and the latch 32 rotates in the clockwise direction in FIG. 5, which is a restraining direction of the latch 32.

Figure 6:
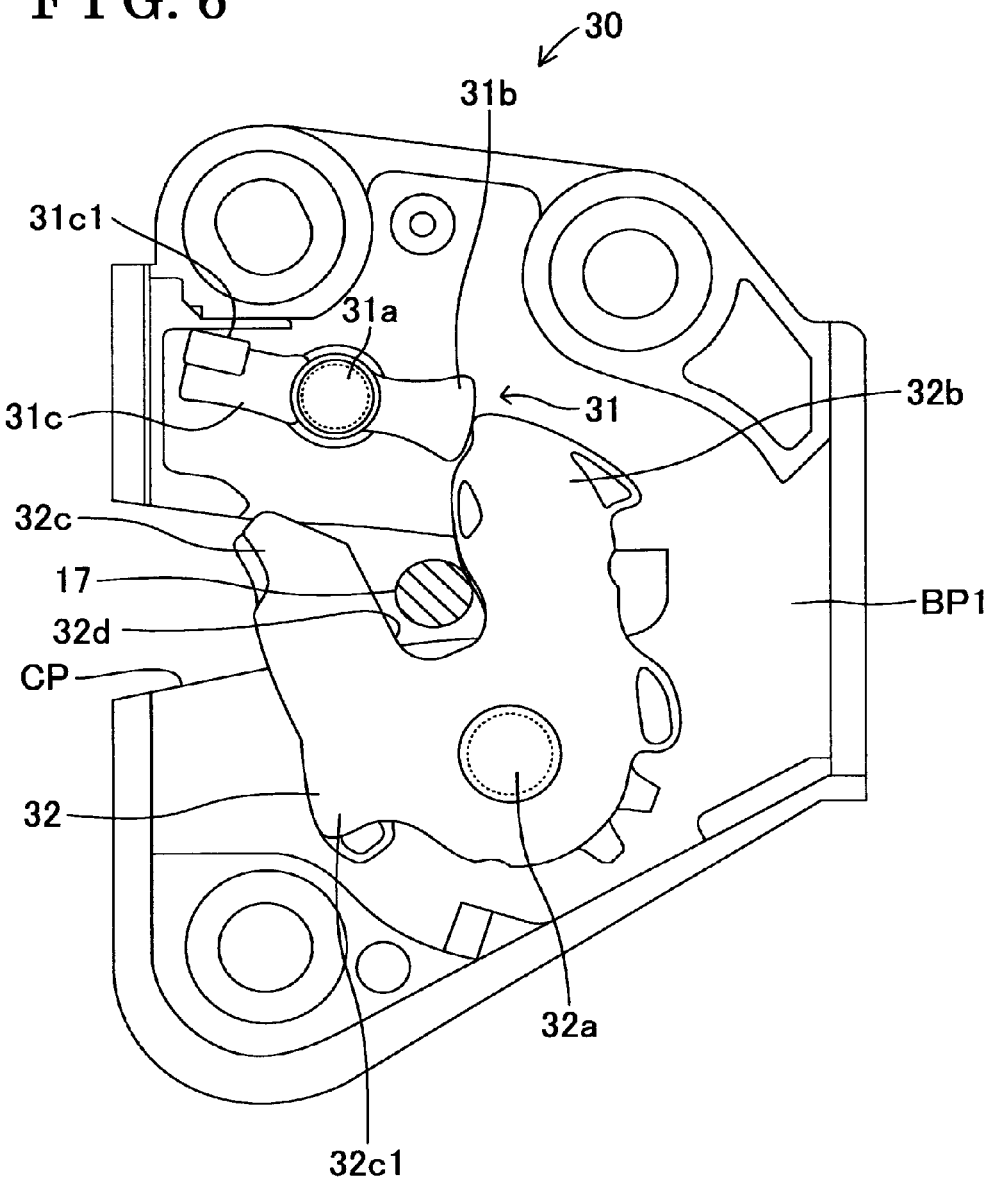
FIG. 6 is an enlarged view drawing illustrating the latch mechanism viewed from frontward in a state where the door is in a half-latch state.
Figure 7:
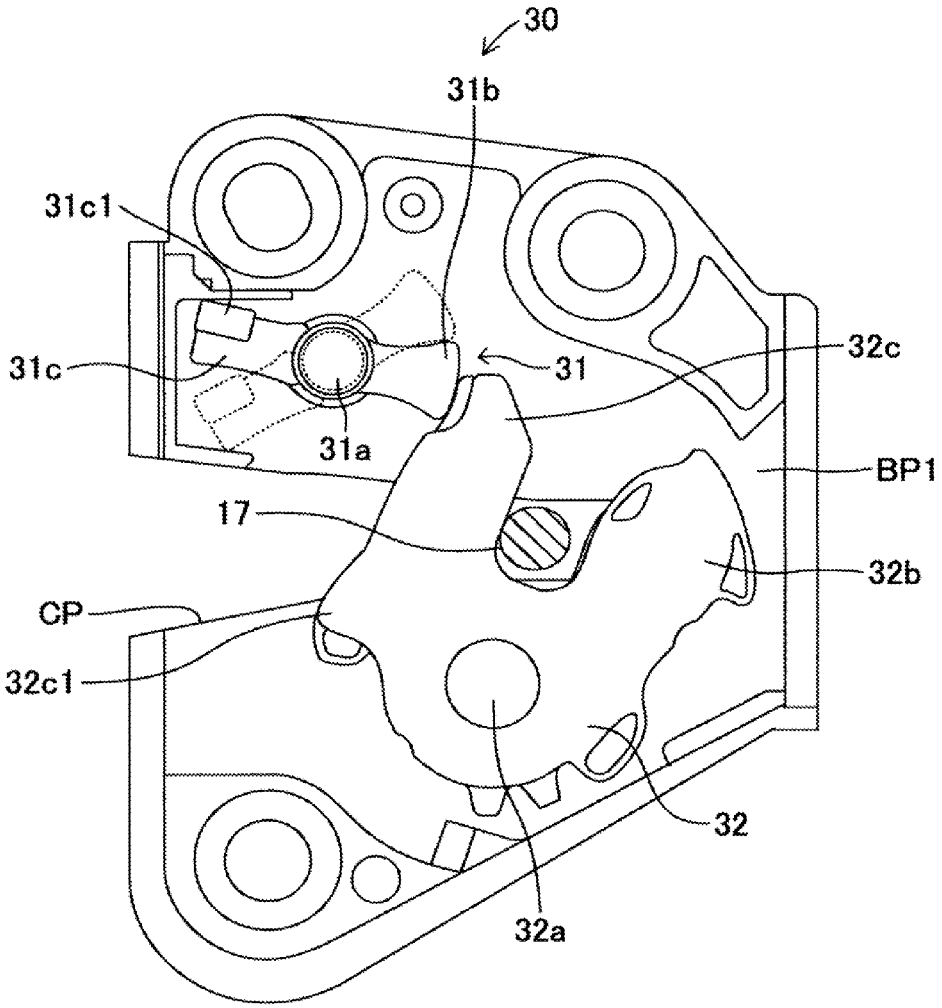
FIG. 7 is an enlarged view drawing illustrating the latch mechanism viewed from frontward in a state where the door is in a full close state.

A rotational position of the latch 32 moves from the unlatch position of the latch 32 shown in FIG. 5 to a rotational position shown in FIG. 7, which is a full-latch position, via a rotational position shown in FIG. 6, which is a half-latch position. At the full-latch position illustrated in FIG. 7, the full-latch projection 32*c* of the latch 32 engages with the latch locking portion 31*b* of the pole 31 to restrain the latch 32 from rotating in the release direction of the latch 32 and to retain a state where the latch 32 retains the striker 17. As a result, the door 10 is retained at a full close position and a full close state is retained. Note that, in a state where the rotational position of the latch 32 is at the half-latch position shown in FIG. 6, the half-latch projection 32*b* of the latch 32 engages with the latch locking portion 31*b* of the pole 31. The state where the latch 32 retains the striker 17 is likewise retained in this state, however, the door 10 is retained at a position close to the full close position and the state of the door 10 is in a state generally known as a half-latch state. Note that, the latch mechanism 30 includes a latch position detector detecting the rotational position of the latch 32. The latch position detector connects to the control portion ECU. The latch position detector sends detected results to the control portion ECU and the control portion ECU receives detected results as inputs.

In a state where the latch 32 retains the striker 17, when the open lever 63 pushes down the portion to be pushed downward 31*c*1, the pole 31 rotates in a counterclockwise direction in FIG. 7, which is a release direction of the pole 31. The pole 31 rotates to a rotational position illustrated with a broken line in FIG. 7, which is an unlock position of the pole 31. At the rotational position illustrated with the broken line, the pole 31 and the latch 32 are not engaged. Accordingly, the latch 32 is released from a state where the pole 31 restrains rotation of the latch 32 so that the latch 32 is allowed to rotate in the release direction of the latch 32. As a result, the latch 32 rotates in the release direction of the latch 32 biased by the torsion coil spring and shifts to the state illustrated in FIG. 5. In other words, the door 10 is released from a state where the latch 32 retains the door 10. The door 10 may be opened in this state.

Furthermore, as FIG. 5 illustrates, at a base portion of the full-latch projection 32*c*, a protruding portion 32*c*1 is formed to protrude radially outward. The protruding portion 32*c*1 makes contact with a see-saw type lever 62, which will be described later, in a state where the rotational position of the latch 32 is at the half-latch position. In a state where the protruding portion 32*c*1 is pushed upwardly by the see-saw type lever 62, the latch 32 rotates so that the rotational position of the latch 32 shifts from the half-latch position to the full-latch position. As a result, a retained state of the door 10 shifts from the half-latch state to the full close state.

The door check mechanism 40 will be described next. As FIG. 3 illustrates, the door check mechanism 40 includes, a rod 41, which serves as an engagement member, and a holding mechanism 42, which serves as a retaining mechanism. The door 10 supports the rod 41 such that the rod 41 advances and retracts relative to the door 10. The holding mechanism 42 retains the rod 41 at a predetermined position. The rod 41 is formed in an elongated form. A cross sectional shape of the rod 41 taken in a direction perpendicular to a longitudinal direction of the rod 41 is substantially a rectangle. A pair of recessed portions 41*a* recessing in the direction perpendicular to the longitudinal direction of the rod 41 are formed on an upward surface and a downward surface of the rod 41 at a portion positioned closer to a first end of the rod 41 in the longitudinal direction relative to the middle portion of the rod 41 in the longitudinal direction. Furthermore, a pair of recessed portions 41*b* recessing in the direction perpendicular to the longitudinal direction of the rod 41 are formed on the upward surface and the downward surface of the rod 41 at the first end of the rod 41 in the longitudinal direction. The first end of the rod 41 is inserted into the inside of the door 10 from an opening 19 provided at a frontward end portion of the door 10.

The holding mechanism 42 is arranged inside of the door body D. The holding mechanism 42 retains the rod 41 by sandwiching the rod 41 from upward and from downward. The holding mechanism 42 includes a housing 42*a* mounted inside of the door 10 at the frontward end portion of the door 10. The housing 42*a* is formed in a box form. The housing 42*a* is provided with an opening portion 42*a*1 on a surface of the housing 42*a* facing the opening 19 of the door 10. The housing 42*a* further includes an opening portion 42*a*2 on a surface of the housing 42*a* facing opposite direction relative to the opening 19 of the door 10. The first end of the rod 41 in the longitudinal direction, which is inserted into the inside of the door 10 from the opening 19, is inserted into inside of the housing 42*a* from the opening portion 42*a*1 and projects outside the housing 42*a*, which is inside of the door body D, through an opening portion 42*a*2. On the rod 41 arranged in this state, a stopper 41*c*, which is an engagement portion, is mounted on the first end of the rod 41 in the longitudinal direction. In a state where the stopper 41*c* is mounted on the first end of the rod 41 in the longitudinal direction, the stopper 41*c* protrudes outward, which is a direction perpendicular to the longitudinal direction, from a peripheral portion of the first end of the rod 41 in the longitudinal direction. The stopper 41*c* makes contact with the housing 42*a* when the rod 41 moves frontward relative to the door 10 and restrains movement of the rod 41 in the frontward direction relative to the door 10. In addition, a second end of the rod 41 in the longitudinal direction is rotatably supported by a supporting member SP mounted on the frontward pillar 14. Inside the housing 42*a*, a pair of pushing members 42*b* facing each other are arranged. The pair of pushing members 42*b* sandwich the rod 41 from the upward and from the downward. Springs 42*c* retained on the housing 42*a* bias the pushing members 42*b* toward the rod 41. Each of the pushing members 42*b* includes a roller member 42*b*1 at an end portion that makes contact with the rod 41. The roller members 42*b*1 roll on an upward surface and a downward surface of the rod 41.

The door check mechanism 40 includes a door open/close sensor 43 detecting an open/close state of the door 10 by detecting a position of the rod 41 relative to the door body D. An example of the door open/close sensor 43 is a sensor formed by a multiple number of switches switching between ON/OFF states by a small projections formed on the rod 41 pushing the switches. Another example of the door open/close sensor 43 is a sensor optically measuring a distance between the sensor and a rearward end surface of the rod 41.

In a state where the door 10 is opened and closed, the rod 41 advances and retracts relative to the door 10. In a state where the door 10 at the full close position is rotated in a vehicle exterior direction, the rod 41 moves frontward relative to the door body D and the pair of pushing members 42*b* fit to a pair of recessed portions 41*a*. As a result, the door 10 is retained in a slightly opened state. The position at a time at which the door is in the slightly opened state is referred to as a door opening ready position, which serves as a predetermined rotational position. In a state where the rod 41 further moves frontward relative to the door body D by the door 10 further rotated in the vehicle exterior direction, the pair of pushing members 42*b* fit to the pair of recessed portions 41*b*. As a result, the door 10 is retained at a full open position. The stopper 41*c* makes contact with the housing 42*a* at this time. As a result, the door 10 is restrained from rotating further in the vehicle exterior direction.

The driving portion 50 will be described next. As FIGS. 3 and 4 illustrates, the driving portion 50 includes a lever mechanism 60 and a drive mechanism 70, which serves as an actuator. The lever mechanism 60 includes an active lever 61, which serves as a first driven member, the see-saw type lever 62, the open lever 63, which serves as a second driven member, a cam type lever 64, a relay lever 65, a rod 66, and a release lever 67, which serves as a third driven member. Direction of a rotational axis for each lever of the lever mechanism 60 is the same. The direction of the rotational axis for each lever is perpendicular to direction of the rotational axis for the pole 31 and the latch 32 retained on the first retaining portion BP1.

Figure 8:
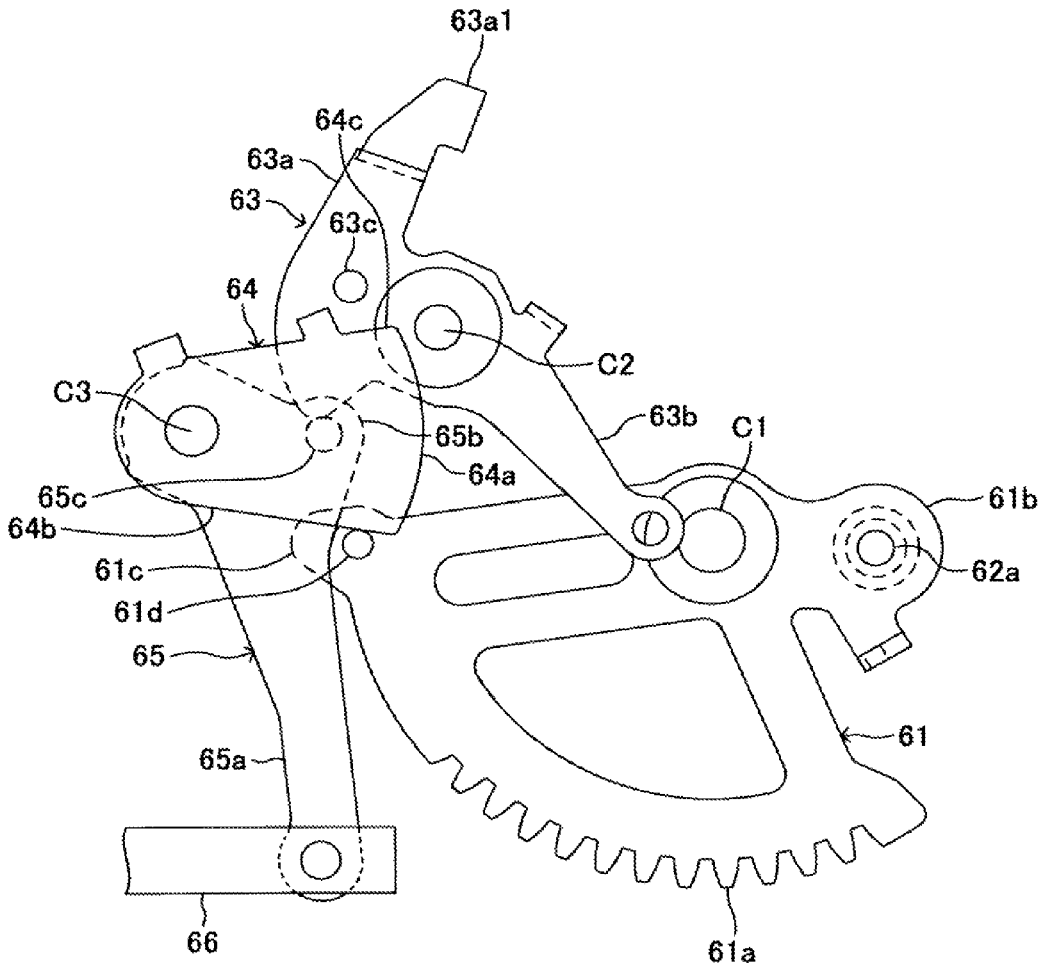
FIG. 8 is an enlarged view drawing illustrating postures of various levers in a state where a contact pin of an active lever makes contact with a cam type lever.

The active lever 61 is formed in substantially a sector form. The second retaining portion BP2 pivotally supports the active lever 61 to be rotatable about an axis C1, which is the center of an arc of the sector form. A gear portion 61*a* is formed at an outer periphery of a curved side of the active lever 61. The active lever 61 includes a protruding retaining portion 61*b* extending rightward in FIG. 4 from the axis C1. The protruding retaining portion 61*b* pivotally supports the see-saw type lever 62, which will be described later, to be rotatable at the protruding retaining portion 61*b*. Furthermore, at an end portion of the curved side of the active lever 61, the end portion in a clockwise direction, a contact portion 61*c* is formed as FIG. 8 illustrates. The contact portion 61*c* is configured to engage with the relay lever 65, which will be described later, in a state where the active lever 61 rotates in a clockwise direction in FIG. 4. At a portion leftward in FIG. 4 relative to the axis C1 of the active lever 61, a contact pin 61*d* in FIG. 4 is formed to protrude in a direction toward the surface where FIG. 4 is drawn. The contact pin 61*d* is configured to engage with the cam type lever 64, which will be described later, in a state where the active lever 61 rotates in the clockwise direction in FIG. 4 with the axis C1 as a center of rotation.

The see-saw type lever 62 includes a first arm 62*b* and a second arm 62*c*. The first arm 62*b* extends from a rotational shaft 62*a* in one direction of the see-saw type lever 62. The second arm 62*c* extends from the rotational shaft 62*a* in an opposite direction relative to the direction the first arm 62*b* extends. In other words, the first arm 62*b* and the second arm 62*c* are arranged in a see-saw state with the rotational shaft 62*a* that is positioned between the first arm 62*b* and the second arm 62*c*. The first arm 62*b* is arranged at a position where an end portion of the first arm 62*b* may contact with the protruding portion 32*c*1 of the latch 32. A contact roller 62*d* is attached to an end portion of the second arm 62*c*. A torsion coil biases the see-saw type lever 62 in a direction that makes the end portion of the first arm 62*b* move away from the protruding portion 32*c*1 of the latch 32.

The second retaining portion BP2 pivotally supports the open lever 63 to be rotatable about an axis C2. The open lever 63 is arranged at a position in a direction opposite to where the second retaining portion BP2 is arranged relative to the active lever 61. In other words, relative to the active lever 61 in FIG. 4, the open lever 63 is positioned in a direction toward the surface where FIG. 4 is drawn. The open lever 63 includes a pole driving portion 63*a* and a positioning portion 63*b*. The pole driving portion 63*a* extends leftward in FIG. 4 from the axis C2 and further extends obliquely upward toward right in FIG. 4. The positioning portion 63*b* extends obliquely downward toward right in FIG. 4 from the axis C2. The pushing down portion 63*a*1 is arranged at an end portion of the pole driving portion 63*a*. The pushing down portion 63*a*1 pushes the portion to be pushed downward 31*c*1 of the pole 31 downward. At a base portion of the pole driving portion 63*a* of the open lever 63, a contact pin 63*c* is formed. The contact pin 63*c* protrudes in a direction opposite to where the second retaining portion BP2 is arranged in FIG. 4, which is a direction toward the surface where FIG. 4 is drawn. The contact pin 63*c* is arranged at a position at which the contact pin 63*c* may contact with the cam type lever 64, which will be described later. Note that, a torsion spring is attached to the open lever 63 so that the open lever 63 is biased in a counterclockwise direction in FIG. 4.

In a state where the door actuating apparatus 20 according to the embodiment is in a state illustrated in FIG. 4, the contact roller 62*d* is in contact with a downward end of the positioning portion 63*b* of the open lever 63 so that the contact roller 62*d* is positioned at a predetermined position. In a state where the active lever 61 rotates in the clockwise direction in FIG. 4 with the axis C1 as the center of rotation, the positioning portion 63*b* of the open lever 63 detaches from the contact roller 62*d*. This process will be described in more detail later. When the positioning portion 63*b* of the open lever 63 detaches from the contact roller 62*d*, the see-saw type lever 62 is released from the predetermined position, which is the position retained by the open lever 63, so that the see-saw type lever 62 is allowed to rotate relative to the active lever 61.

As FIG. 4 illustrates, the second retaining portion BP2 pivotally supports the cam type lever 64 and the relay lever 65 to be rotatable at an axis C3, which is a position distanced from the axis C2 of the open lever 63 at a position obliquely downward toward left in FIG. 4. The cam type lever 64 is arranged at a position in the direction opposite to where the second retaining portion BP2 is arranged relative to the open lever 63. In other words, the cam type lever 64 in FIG. 4 is arranged at a position in a direction toward the surface where FIG. 4 is drawn relative to the open lever 63. The cam type lever 64 is formed in substantially a sector form. More specifically, the cam type lever 64 includes an arc surface portion 64*a* formed in a circularly curved surface form and flat surface portions 64*b*, 64*c* formed in a flat surface form extending toward the axis C3 from each end of the arc surface portion 64*a*, the end in a circumferential direction. A torsion spring is attached to the cam type lever 64 to bias the cam type lever 64 in the clockwise direction in FIG. 4.

The relay lever 65 is arranged at a position in a direction opposite to where the second retaining portion BP2 is arranged relative to the active lever 61, which is a position in a direction of the second retaining portion BP2 relative to the open lever 63. In other words, the relay lever 65 is arranged between the active lever 61 and the open lever 63. The relay lever 65 includes a connecting portion 65*a* extending obliquely downward toward right in FIG. 4 from the axis C3 of the relay lever 65 and a protruding portion 65*b* protruding obliquely upward toward right in FIG. 8 from the axis C3 of the relay lever 65, as FIG. 8 illustrates. On the protruding portion 65*b*, a contact pin 65*c* is formed to protrude in a direction toward the second retaining portion BP2 from a central portion of the protruding portion 65*b*. In a state where the door 10 is at the full close position, the contact pin 65*c* is positioned at a position in an upward direction in FIG. 4 relative to the contact portion 61*c* of the active lever 61.

The rod 66 is arranged to extend in a vehicle frontward-rearward direction, as FIG. 3 illustrates. A rearward end of the rod 66 is mounted on an end portion of the connecting portion 65*a* of the relay lever 65. A frontward end of the rod 66 is linked to the release lever 67, which will be described later. The rod 66 includes a coil spring 66*a* serving as a limiter mechanism at an intermediate position of the rod 66. The coil spring 66*a* and the rod 66 share an axis in a straight line. In a state where an external force that makes the rod 66 expand in a direction conforming to the axis of the rod 66 is exerted on the rod 66, the coil spring 66*a* expands in the direction conforming to the axis of the rod 66.

As FIG. 3 illustrates, the release lever 67 is pivotally supported at an axis C4 to be rotatable about the axis C4. The axis C4 is at a position distanced obliquely downward toward left in FIG. 3 from the axis C3 of the cam type lever 64 and the relay lever 65 and distanced obliquely upward toward right in FIG. 3 from a rearward end of the rod 41 of the door check mechanism 40. The release lever 67 includes a link portion 67*a* and a pushing portion 67*b*. The link portion 67*a* extends obliquely upward toward right in FIG. 3 from the axis C4. The pushing portion 67*b* extends from the axis C4 in a direction opposite to the direction the link portion 67*a* extends. In a state where the door 10 is at the full close position, the pushing portion 67*b* is in contact with the rearward end of the rod 41. The release lever 67 rotates in a clockwise direction in FIG. 3 with the axis C4 as the center of rotation in a state where the rod 66 moves in a rearward direction. As a result, the pushing portion 67*b* pushes a rearward end surface of the rod 41 frontward.

The drive mechanism 70 includes the electric motor 71. The electric motor 71 is fixed at an appropriately selected position on the second retaining portion BP2. An output shaft of the electric motor 71 connects to the gear portion 61*a* formed at the outer peripheral end of the active lever 61 via a reducer 72 formed by a multiple number of gears. The control portion ECU sends a drive signal DS, which is a signal to rotate the electric motor 71 in a positive direction, to the electric motor 71 when the control portion ECU detects a state where the operating portion CT is operated while the door 10 is at the full close position. Note that, a rotational position of the output shaft of the electric motor 71 or the rotational position of the gears forming the reducer 72 during a period during which the door 10 is at the full close position is referred to as an initial position. Furthermore, a rotation number or a rotational angle from the initial position of the electric motor 71 or the gears forming the reducer 72 is referred to as an actuated position of the drive mechanism 70, which serves as an actuated position of the actuator.

Figure 9:
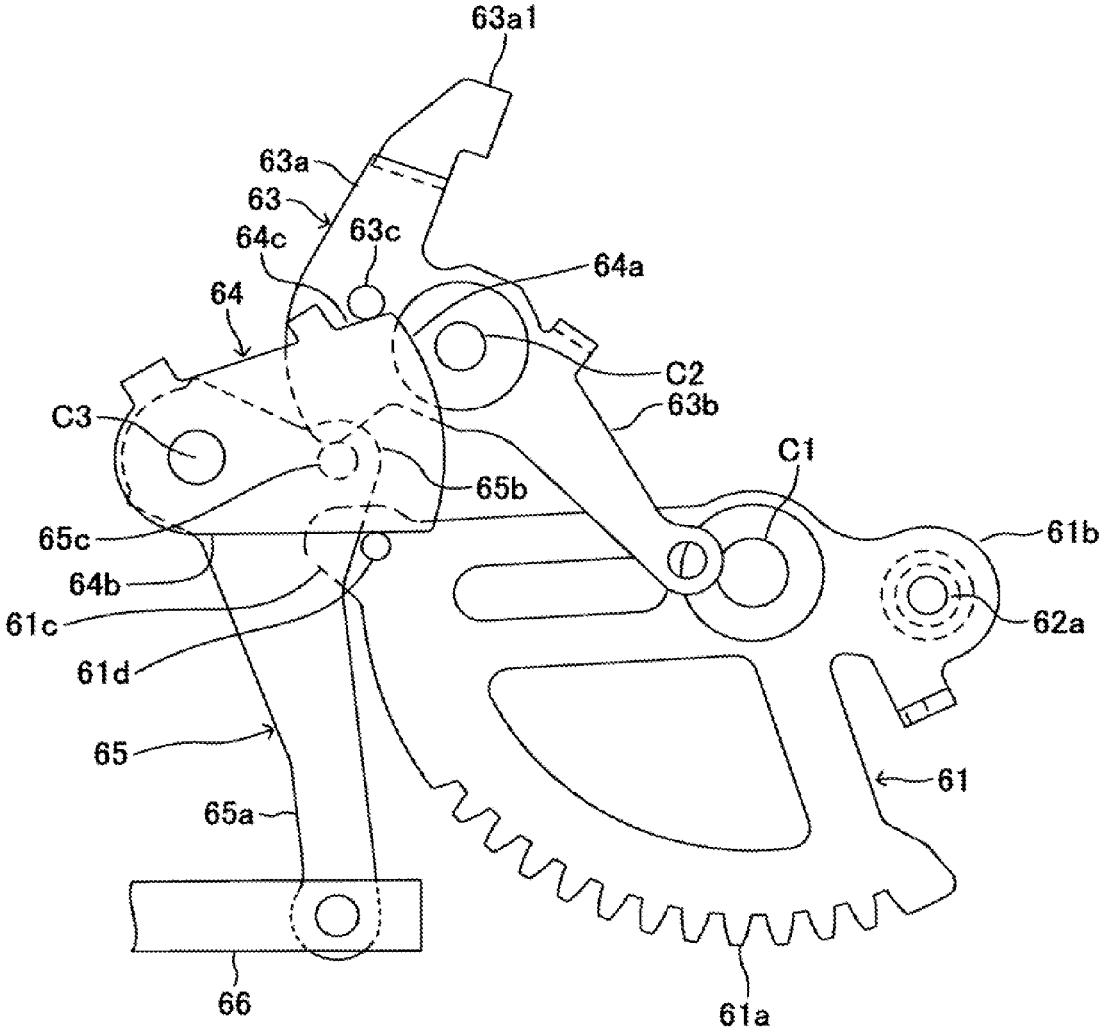
FIG. 9 is an enlarged view drawing illustrating postures of various levers in a state where the cam type lever makes contact with a contact pin of an open lever.

An operation of the door actuating apparatus 20 according to the embodiment will be described next. While the door 10 is retained by the latch mechanism 30 at the full close position, when the control portion ECU detects that the operating portion CT is operated, the control portion ECU sends the drive signal DS to the electric motor 71 to rotate the electric motor 71 in the positive direction. As a result, the active lever 61 rotates in the clockwise direction in FIG. 4 with the axis C1 as the center of rotation so that the contact pin 61*d* of the active lever 61 makes contact with the flat surface portion 64*b* of the cam type lever 64, as FIG. 8 illustrates. In this state, the contact portion 61*c* of the active lever 61 is at a position in a downward direction relative to the contact pin 65*c* of the relay lever 65. Accordingly, the contact portion 61*c* and the contact pin 65*c* are not engaged with each other. In a state where the active lever 61 further rotates in a clockwise direction in FIG. 8, the cam type lever 64 rotates in a counterclockwise direction in FIG. 8 with the axis C3 as the center of rotation. Accordingly, the flat surface portion 64*c* of the cam type lever 64 makes contact with the contact pin 63*c* of the open lever 63, as FIG. 9 illustrates. An actuated position of the drive mechanism 70 in this state is referred to as a first position in the door actuating apparatus 20 according to this disclosure. In a state where the cam type lever 64 further rotates in a counterclockwise direction in FIG. 9 with the axis C3 as the center of rotation, the flat surface portion 64*c* pushes the contact pin 63*c*, which in turn makes the open lever 63 rotates in a clockwise direction in FIG. 9 with the axis C2 as the center of rotation, so that the pushing down portion 63*a*1 arranged on the pole driving portion 63*a* of the open lever 63 pushes the portion to be pushed downward 31*c*1 of the pole 31 downward, as FIG. 4 illustrates. An actuated position of the drive mechanism 70 in a state where the portion to be pushed downward 31*c*1 is completely pushed downward is referred to as a second position in the door actuating apparatus 20 according to this disclosure. In this process, a contact point between the contact pin 63*c* and the flat surface portion 64*c* moves from a direction of the axis C3 toward the arc surface portion 64*a*. Furthermore, the positioning portion 63*b* of the open lever 63 is positioned at a position distanced from the contact roller 62*d*. Accordingly, the see-saw type lever 62 is released from being retained at the predetermined position by the open lever 63 and rotation of the see-saw type lever 62 relative to the active lever 61 is allowed. The see-saw type lever 62 is biased by the torsion coil spring so that an end portion of the first arm 62*b* detaches from the protruding portion 32*c*1 of the latch 32. Accordingly, the latch 32 rotates in the release direction of the latch 32 to release the door 10 from being retained at the full close position.

Figure 10:
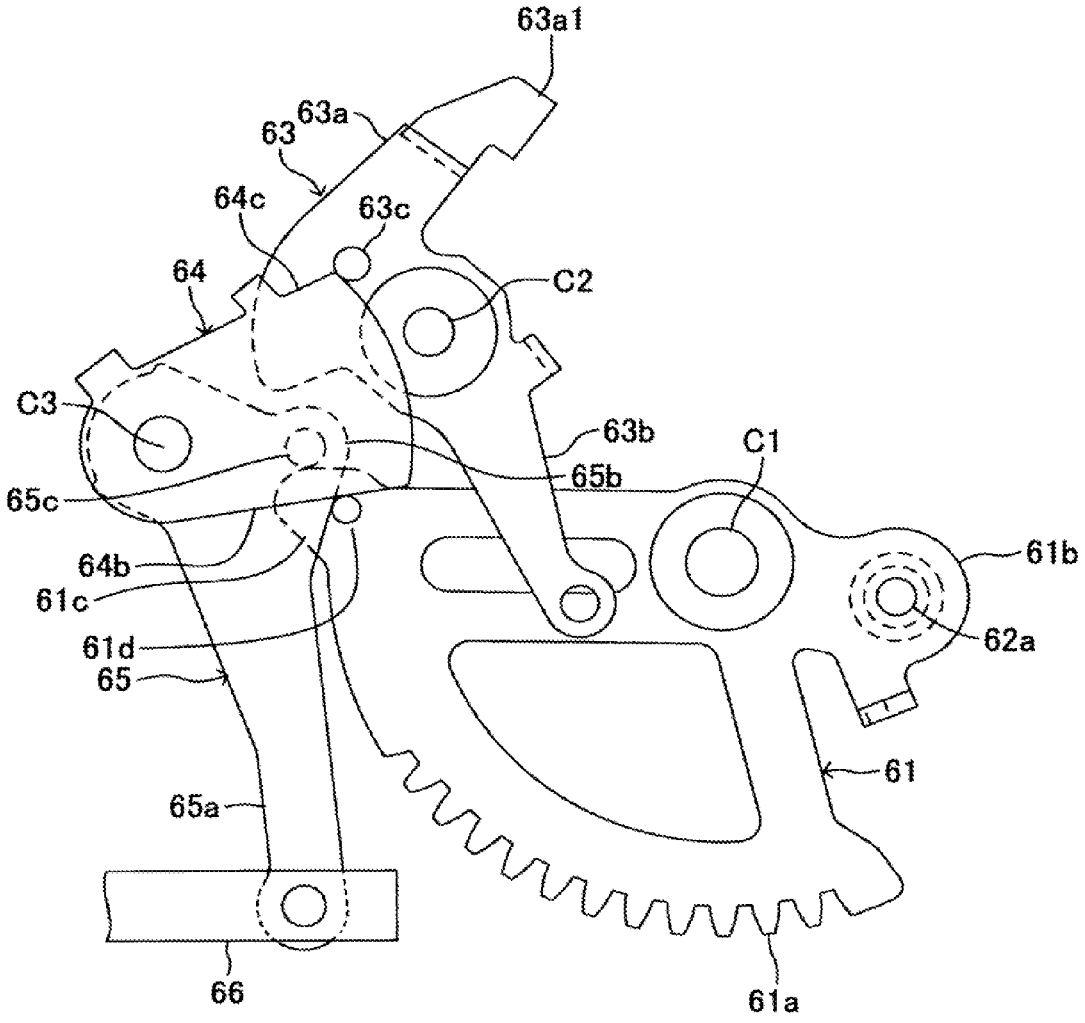
FIG. 10 is an enlarged view drawing illustrating postures of various levers in a state where the active lever makes contact with a relay lever.

The cam type lever 64 rotates in the counterclockwise direction in FIG. 9 with the axis C3 as the center of rotation as a result of the active lever 61 further rotating in the clockwise direction in FIG. 9 with the axis C1 as the center of rotation. Accordingly, a state of the contact pin 63*c* of the open lever 63 shifts from a state in which the contact pin 63*c* is in contact with the flat surface portion 64*c* to a state in which the contact pin 63*c* is in contact with the arc surface portion 64*a*, as FIG. 10 illustrates. Accordingly, the open lever 63 is restrained from further rotating even in a state where the cam type lever 64 further rotates. As a result, a state in which the pushing down portion 63*a*1 pushing down the portion to be pushed downward 31*c*1 is retained.

Figure 11:
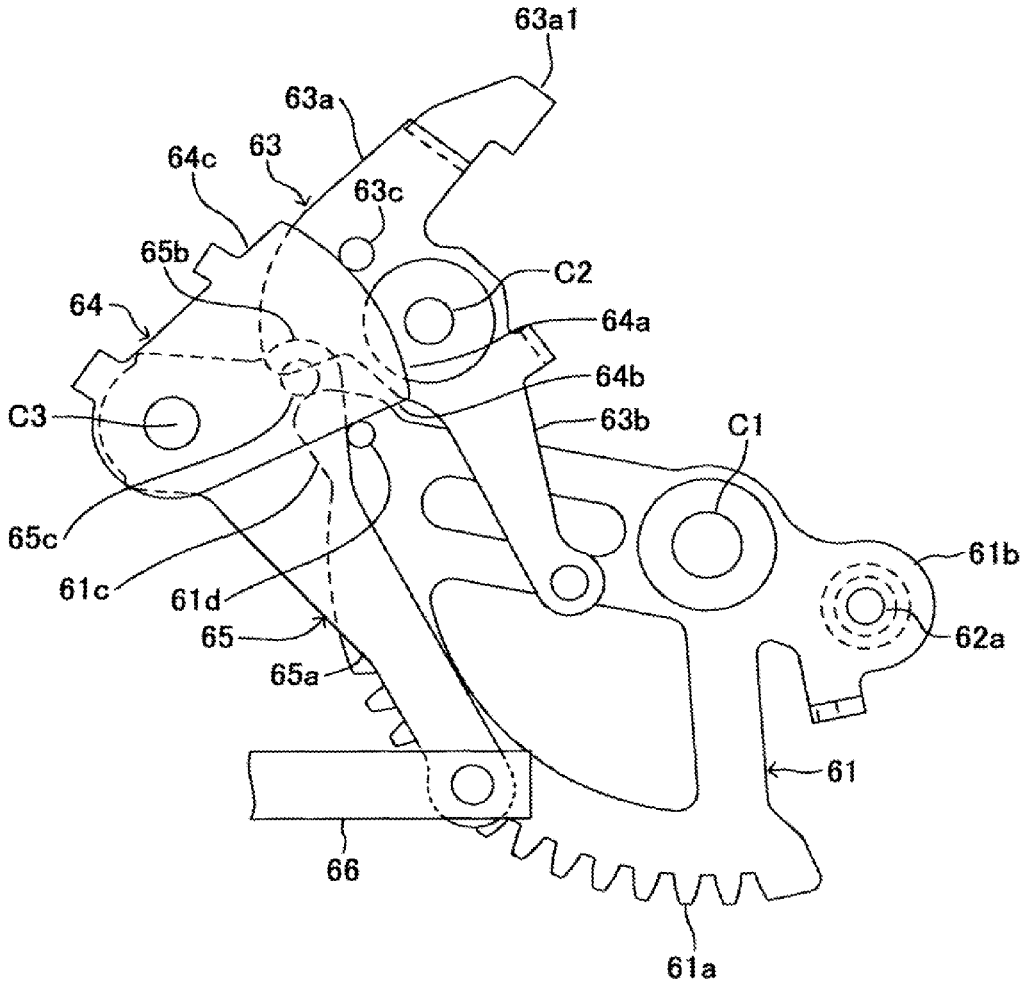
FIG. 11 is an enlarged view drawing illustrating postures of various levers in a state where the relay lever rotates pushed by the active lever.

When the state of the contact pin 63*c* of the open lever 63 shifts from the state in which the contact pin 63*c* is in contact with the flat surface portion 64*c* to the state in which the contact pin 63*c* is in contact with the arc surface portion 64*a*, the contact portion 61*c* of the active lever 61 makes contact with the contact pin 65*c* of the relay lever 65 so that the contact pin 65*c* is pushed upward. An actuated position of the drive mechanism 70 in a state where the contact portion 61*c* of the active lever 61 makes contact with the contact pin 65*c* of the relay lever 65 is referred to as a third position in the door actuating apparatus 20 according to this disclosure. As a result, the relay lever 65 rotates in a counterclockwise direction in FIG. 10 with the axis C3 as the center of rotation so that the rod 66 moves rearward, as FIG. 11 illustrates. Accordingly, the release lever 67 rotates in the clockwise direction in FIG. 3 with the axis C4 as the center of rotation and the pushing portion 67*b* of the release lever 67 pushes the rearward end of the rod 41 frontward. As a result, the rod 41 moves frontward so that the door 10 starts rotating in a direction toward vehicle exterior. When the rod 41 moves frontward and the recessed portions 41*a* formed on the rod 41 reaches at positions directly above and below the pushing members 42*b*, which are the positions corresponding to the door opening ready position, the pushing members 42*b* fit to the recessed portions 41*a*. Accordingly, the door 10 is retained at the door opening ready position. More specifically, in a state where an external force to rotate the door 10 is exerted on the door 10, the rod 41 is biased to return to the position corresponding to the door opening ready position by the pushing members 42*b* of the holding mechanism 42, which serves as a biasing mechanism. Note that, the door 10 may rotate toward the full close position or toward the full open position in a case where the external force is large enough to make the pushing members 42*b* detach from the recessed portions 41*a*. Operation of the door actuating apparatus 20 according to the embodiment in a case in which a large external force is exerted on the door 10 will be described later. An actuated position of the drive mechanism 70 in a state where the door 10 is retained at the door opening ready position is referred to as a fourth position in the door actuating apparatus according to this disclosure.

In a state where an external force large enough to further rotate the door 10 in the direction toward vehicle exterior is exerted on the door 10, the springs 42*c* are compressed and the pushing members 42*b* fitted to the recessed portions 41*a* detach from the recessed portions 41*a* so that the rod 41 further move frontward and the door 10 further opens. When the stopper 41*c* makes contact with the housing 42*a*, the door 10 is restrained from further rotating in the vehicle exterior direction so that the door 10 stops at the full open position.

At this time, the rearward end of the rod 41 is at a position detached from the pushing portion 67*b* of the release lever 67. In addition, in a state where the door open/close sensor 43 arranged on the door check mechanism 40 detects that the door 10 is opened, the door open/close sensor 43 transmits a door open signal OS, which indicates that the door 10 is opened, to the control portion ECU. When the control portion ECU receives the door open signal OS, the control portion ECU sends a drive signal DS, which is a signal commanding the electric motor 71 to rotate in a negative direction, to the electric motor 71 to rotate the electric motor 71 in the negative direction. As a result, the active lever 61 rotates in a counterclockwise direction with the axis C1 as the center of rotation. Accordingly, each of the release lever 67, the cam type lever 64, and the open lever 63 rotates in an opposite direction in a reversed order compared to when the door 10 is actuated, or driven, to open so that the open lever 63 and the release lever 67 returns to positions illustrated in FIGS. 3 and 4. As a result, a state of each of the release lever 67, the cam type lever 64, and the open lever 63 shifts to the state in which a user may close the door 10. More specifically, the pushing down portion 63*a*1 arranged on the pole driving portion 63*a* of the open lever 63 detaches from the portion to be pushed downward 31*c*1 of the pole 31 so that the pole 31 returns to a position illustrated in FIG. 5 biased by the torsion coil spring. In other words, the pole 31 shifts to a state engageable with the latch 32.

On the other hand, in a state where the door 10 is at the door opening ready position, in a case where an external force that rotates the door 10 in the vehicle interior direction is exerted on the door 10, the rod 41 moves rearward. Accordingly, the rod 41 pushes the pushing portion 67*b* of the release lever 67 so that the release lever 67 rotates in the counterclockwise direction in FIG. 3 with the axis C4 as the center of rotation. The rearward end of the rod 66 is connected to the connecting portion 65*a* of the relay lever 65. At the same time, the relay lever 65 is restrained from rotating by the active lever 61. Accordingly, in this case, the rod 66 is exerted with the external force that expands the rod 66 in the axial direction. As a result, the coil spring 66*a* is expanded and portion of the rod 66 positioned frontward relative to the coil spring 66*a* exclusively moves frontward. In a state where the external force exerted on the door 10 is removed, the coil spring 66*a* returns to an original length, which is a natural length of the coil spring 66*a*. Likewise, the portion of the rod 66 positioned frontward relative to the coil spring 66*a* and the release lever 67 return to original positions. As a result, the door 10 return to the door opening ready position.

In a state where the control portion ECU detects that a state of the door 10 is in a half-latch state, the control portion ECU sends a driving signal DS, which is a signal commanding the electric motor 71 to rotate in a negative direction, to the electric motor 71. In a state where the electric motor 71 rotates in the negative direction, the active lever 61 rotates in the counterclockwise direction in FIG. 4 with the axis C1 as the center of rotation. At this time, the contact roller 62*d* is in contact with a downward end portion of the positioning portion 63*b* of the open lever 63 to retain the contact roller 62*d* at the predetermined position. Accordingly, in a state where the active lever 61 rotates from a position illustrated in FIG. 4 in the counterclockwise direction in FIG. 4 with the axis C1 as the center of rotation, the first arm 62*b* makes contact with the protruding portion 32*c*1 of the latch 32 so that the protruding portion 32*c*1 is pushed upward. As a result, the latch 32 rotates to shift the rotational position of the latch 32 from the half-latch position to the full-latch position so that the retained state of the door 10 shifts from the half-latch state to the full close state.

Upon the arrangement of the door actuating apparatus 20 according to the embodiment, when the operating portion CT is operated in a state where the door 10 is at the full close position, the driving portion 50 is driven and the door 10 is released from being retained. Furthermore, the door 10 is actuated to automatically open to the door opening ready position. As a result, an operational force at a beginning of opening the door 10 is light. In addition, without providing the electric motor 71 in multiple numbers, the door 10 may be released from being retained and the door 10 may be opened to the door opening ready position. Accordingly, a configuration of the control portion ECU of the door actuating apparatus 20 may be simplified, reduced in size, and cost of the door actuating apparatus 20 may be reduced. Note that, the door 10 is manually rotated from the door opening ready position to the full open position. Nevertheless, the operational force to rotate the door 10 from the door opening ready position to the full open position is considerably small. Accordingly, in a state where the door 10 is arranged to automatically open from the full close position to the door opening ready position similarly to the door actuating apparatus 20 according to the embodiment, an ease of operation is greatly enhanced compared to a door provide without the door actuating apparatus 20 according to the embodiment. In addition, during a period during which the door 10 is actuated by the electric motor 71 from the full close position to the door opening ready position, a state of the door 10 is retained in the disengaged state. As a result, the door 10 may be manually rotated at any time during a period during which the door 10 is making rotational movement from the full close position to the door opening ready position, without waiting for the door to reach the door opening ready position. Furthermore, when the operating portion CT is operated in a state where the door 10 is at the full close position, the door 10 opens and then the door 10 is retained at the door opening ready position by the door check mechanism 40. Accordingly, the door 10 is restrained from hitting an obstacle positioned at a position in the vehicle exterior direction when the door 10 opens by an unintentionally large amount by inertia at a time at which the door 10 is operated to open. Furthermore, when an external force making the door 10 rotate in the vehicle interior direction is exerted on the door 10 in a state where the door 10 is in the door opening ready position, the coil spring

66*a* expands and the portion of the rod 66 in the frontward direction relative to the coil spring 66*a* exclusively moves frontward. Accordingly, for example, the rod 41, the rod 66 and various levers are restrained from being damaged.

The door actuating apparatus 20 according to the embodiment is not limited to the embodiment described herewith and may be modified or enhanced in following manners.

For example, in the door actuating apparatus 20 according to the embodiment, the relay lever 65 is configured to rotate after the open lever 63 rotates, however, the open lever 63 and the relay lever 65 may start rotating at the same time. In this configuration, a clearance may be defined between the release lever 67 and the rod 41 in a state where the door 10 is at the full close position. Accordingly, the release lever 67 makes contact with the rearward end of the rod 41 when the relay lever 65 reaches the predetermined rotational position after the relay lever 65 starts rotating. As a result, similarly to the door actuating apparatus 20 according to the embodiment, the door 10 starts opening after the door 10 is released from being retained by the latch mechanism 30.

Alternatively, instead of arranging the release lever 67 to directly push the rod 41, the release lever 67 may be used as a trigger to bias the rod 41 frontward. For example, a biasing member, for example, a spring, biasing the rod 41 frontward and a stopper to lock the rod 41 against a biasing force of the biasing member may be separately provided. More specifically, the release lever 67 may be arranged to contact with the stopper to release the rod 41 from being retained by the stopper so that the rod 41 receives the biasing force of the biasing member.

The door 10 in the door actuating apparatus 20 according to the embodiment is retained at the door opening ready position and at the full open position by the holding mechanism 42 of the door check mechanism 40. Alternatively, additional recessed portions similar to the recessed portions 41*a* may be formed on the upward surface and the downward surface of the rod 41 to retain the door 10 at additional rotational positions. Furthermore, the door check mechanism 40 may be provided with a holding mechanism that may retain the door 10 at a selected rotational position.

According to an aspect of this disclosure, a door actuating apparatus 20 includes an engagement mechanism (a latch mechanism 30) selectively achieving an engaged state and a disengaged state, the engagement mechanism (the latch mechanism 30) configured to achieve the engaged state where a door 10 that is rotatably supported by a vehicle body is retained at a full close position, the engagement mechanism (the latch mechanism 30) configured to achieve the disengaged state where the door 10 is not retained at the full close position, an operating portion CT configured to be operated for rotating the door 10 that is at the full close position outward relative to a vehicle interior 11, the operating portion CT outputting a signal for rotating the door 10, a control unit ECU receiving the signal from the operating portion CT, the control unit ECU actuating an actuator (a drive mechanism 70) in response to the signal, an engagement member (a rod 41) configured to be retained by the vehicle body and configured to engage with the door 10, the engagement member (the rod 41) advancing and retracting relative to the door 10 in accordance with rotation of the door 10, and a door opening mechanism (a door check mechanism 40, a driving portion 50) operating by actuation of the actuator (the drive mechanism 70), the door opening mechanism (the door check mechanism 40, the driving portion 50) shifting a state of the engagement mechanism (the latch mechanism 30) from the engaged state to the disengaged state by engaging with the engagement mechanism (the latch mechanism 30) that is in the engaged state, the door opening mechanism (the door check mechanism 40, the driving portion 50) engaging with the engagement member configured to rotate the door 10 from the full close position to a predetermined rotational position positioned between the full close position and a full open position, the door opening mechanism (the door check mechanism 40, the driving portion 50) separating from the engagement member (the rod 41) configured to allow the door 10 to rotate in a vehicle exterior direction relative to a rotational position of the door 10 corresponding to an operational position of the door opening mechanism (the door check mechanism 40, the driving portion 50) in a state where an external force rotating the door 10 in the vehicle exterior direction is exerted on the door 10 in a case where the engagement mechanism (the latch mechanism 30) is in the disengaged state.

Upon the arrangement described herewith, the door opening mechanism (the door check mechanism 40, the driving portion 50) releases the door 10 from being retained when the operating portion CT, for example, a switch arranged on a portable device or on a vehicle, is operated to operate the door 10 at the full close position. In other words, a state of the engagement mechanism (the latch mechanism 30) switches from the engaged state to the disengaged state. At the same time, the actuator (the drive mechanism 70) actuates the door 10 and the door 10 automatically opens to the predetermined rotational position. As a result, an operational force at a beginning of opening the door 10 is small. In addition, without providing the actuator (the drive mechanism 70) in multiple numbers, the door 10 may be released from being retained and the door 10 may be opened to the predetermined rotational position. Accordingly, a drive circuit and the control unit (the control portion ECU) of the door actuating apparatus 20 may be simplified, reduced in size, and cost of the door actuating apparatus 20 may be reduced. The door 10 is manually rotated from the predetermined rotational position to the full open position. Nevertheless, the operational force to rotate the door 10 from the predetermined rotational position to the full open position is considerably small. Accordingly, in a state where the door 10 is arranged to automatically open from the full close position to the predetermined rotational position, an ease of operation is greatly enhanced compared to a door provided without the door actuating apparatus 20 according to this disclosure. In addition, during a period during which the door 10 is actuated by the actuator (the drive mechanism 70) from the full close position to the predetermined rotational position, a state of the engagement mechanism (the latch mechanism 30) is retained in the disengaged state. As a result, the door 10 may be manually rotated at any time during a period during which the door 10 is making rotational movement from the full close position to the predetermined rotational position, without waiting for the door to reach the predetermined rotational position.

According to another aspect of this disclosure, the door opening mechanism (the door check mechanism 40, the driving portion 50) of the door actuating apparatus 20 engages with the engagement member after the door opening mechanism (the door check mechanism 40, the driving portion 50) shifts the state of the engagement mechanism (the latch mechanism 30) from the engaged state to the disengaged state by engaging with the engagement mechanism (the latch mechanism 30) in the engaged state and is configured to rotate the door 10 from the full close position to the predetermined rotational position.

Upon the arrangement described herewith, the door opening mechanism (the door check mechanism 40, the driving portion 50) releases the door 10 from being retained when the operating portion CT, for example, a switch arranged on a portable device or on a vehicle, is operated to operate the door 10 at the full close position. In other words, a state of the engagement mechanism (the latch mechanism 30) switches from the engaged state to the disengaged state. At the same time, the actuator (the drive mechanism 70) actuates the door 10 and the door 10 automatically opens to the predetermined rotational position. As a result, an operational force at a beginning of opening the door 10 is small. In addition, without providing the actuator (the drive mechanism 70) in multiple numbers, the door 10 may be released from being retained and the door 10 may be opened to the predetermined rotational position. Accordingly, a drive circuit and the control unit (the control portion ECU) of the door actuating apparatus 20 may be simplified, reduced in size, and cost of the door actuating apparatus 20 may be reduced. The door 10 is manually rotated from the predetermined rotational position to the full open position. Nevertheless, the operational force to rotate the door 10 from the predetermined rotational position to the full open position is considerably small. Accordingly, in a state where the door 10 is arranged to automatically open from the full close position to the predetermined rotational position, an ease of operation is greatly enhanced compared to a door provided without the door actuating apparatus 20 according to this disclosure. In addition, during a period during which the door 10 is actuated by the actuator (the drive mechanism 70) from the full close position to the predetermined rotational position, a state of the engagement mechanism (the latch mechanism 30) is retained in the disengaged state. As a result, the door 10 may be manually rotated at any time during a period during which the door 10 is making rotational movement from the full close position to the predetermined rotational position, without waiting for the door to reach the predetermined rotational position.

According to further aspect of this disclosure, the door opening mechanism (the door check mechanism 40, the driving portion 50) of the door actuating apparatus 20 includes a first driven member (an active lever 61) moving in accordance with an actuated position of the actuator (the drive mechanism 70), a second driven member (an open lever 63) driven by the first driven member (the active lever 61), the second driven member (the open lever 63) engaging with the engagement mechanism (the latch mechanism 30), and a third driven member (a release lever 67) driven by the first driven member (the active lever 61), the third driven member (the release lever 67) engaging with the engagement member (the rod 41). The door opening mechanism (the door check mechanism 40, the driving portion 50), in a process where the actuated position of the actuator (the drive mechanism 70) shifts in one direction from a position corresponding to the full close position of the door 10, shifts the state of the engagement mechanism (the latch mechanism 30) in the engaged state to the disengaged state by the second driven member (the open lever 63) pushing an engaging portion (a portion to be pushed downward 31*c*1) of the engagement mechanism (the latch mechanism 30) in a state where the actuated position of the actuator (the drive mechanism 70) shifts from a first position to a second position positioned at a position in the aforementioned one direction relative to the first position, moves position of the engagement member (the rod 41) relative to the door 10 from a position corresponding to the full close position of the door 10 to a position corresponding to the predetermined rotational position by the third driven member (the release lever 67) pushing an engagement portion (a stopper 41*c*) of the engagement member (the rod 41) in a state where the actuated position of the actuator (the drive mechanism 70) is at the second position or in a state where the actuated position of the actuator (the drive mechanism 70) shifts from a third position positioned at a position in the aforementioned one direction relative to the second position to a fourth position positioned at a position in the aforementioned one direction relative to the third position, retains a state of the engagement mechanism (the latch mechanism 30) in the disengaged state in a state where the actuated position of the actuator (the drive mechanism 70) is at a position in the aforementioned one direction relative to the second position, and configured to allow the door 10 to rotate in the vehicle exterior direction relative to the rotational position of the door 10 corresponding to the actuated position of the actuator (the drive mechanism 70) by the engagement portion (the stopper 41*c*) of the engagement member (the rod 41) separating from the third driven member (the release lever 67) in a state where the external force rotating the door 10 in the vehicle exterior direction is exerted on the door 10 in a case where the engagement mechanism (the latch mechanism 30) is in the disengaged state.

Upon the arrangement described herewith, the door opening mechanism (the door check mechanism 40, the driving portion 50) releases the door 10 from being retained when the operating portion CT, for example, a switch arranged on a portable device or on a vehicle, is operated to operate the door 10 at the full close position. In other words, a state of the engagement mechanism (the latch mechanism 30) switches from the engaged state to the disengaged state. At the same time, the actuator (the drive mechanism 70) actuates the door 10 and the door 10 automatically opens to the predetermined rotational position. As a result, an operational force at a beginning of opening the door 10 is small. In addition, without providing the actuator (the drive mechanism 70) in multiple numbers, the door 10 may be released from being retained and the door 10 may be opened to the predetermined rotational position. Accordingly, a drive circuit and the control unit (the control portion ECU) of the door actuating apparatus 20 may be simplified, reduced in size, and cost of the door actuating apparatus 20 may be reduced. The door 10 is manually rotated from the predetermined rotational position to the full open position. Nevertheless, the operational force to rotate the door 10 from the predetermined rotational position to the full open position is considerably small. Accordingly, in a state where the door 10 is arranged to automatically open from the full close position to the predetermined rotational position, an ease of operation is greatly enhanced compared to a door provided without the door actuating apparatus 20 according to this disclosure. In addition, during a period during which the door 10 is actuated by the actuator (the drive mechanism 70) from the full close position to the predetermined rotational position, a state of the engagement mechanism (the latch mechanism 30) is retained in the disengaged state. As a result, the door 10 may be manually rotated at any time during a period during which the door 10 is making rotational movement from the full close position to the predetermined rotational position, without waiting for the door to reach the predetermined rotational position.

According to another aspect of this disclosure, the door actuating apparatus 20 further includes a limiter mechanism (a coil spring 66*a*) blocking a force in accordance with an external force from the engagement member (the rod 41) to the door opening mechanism (the door check mechanism 40, the driving portion 50) in a state where an external force rotating the door 10 in a vehicle interior direction is exerted on the door 10 in a case where the engagement mechanism (the latch mechanism 30) is in the disengaged state.

Accordingly, the door opening mechanism (the door check mechanism 40, the driving portion 50) is restrained from being damaged at a time at which the external force is transmitted to components forming the door opening mechanism (the door check mechanism 40, the driving portion 50).

According to further aspect of this disclosure, the door actuating apparatus 20 further includes a retaining mechanism (a holding mechanism 42) retaining the engagement member (the rod 41), the retaining mechanism (the holding mechanism 42) configured to retain the engagement member (the rod 41) on the door 10 at the position corresponding to the predetermined rotational position of the door 10.

Upon the arrangement described herewith, when the operating portion CT is operated to operate the door 10 positioned at the full close position, the door 10 opens to the predetermined rotational position and retained at the predetermined rotational position. Accordingly, the door 10 is restrained from hitting an obstacle positioned at a position in the vehicle exterior direction when the door 10 opens by an unintentionally large amount by inertia at a time at which the door 10 is operated to open.

According to another aspect of this disclosure, the door actuating apparatus 20 further includes a biasing mechanism (the holding mechanism 42) exerting a force on the engagement member (the rod 41), the force that is in a direction to restore position of the engagement member (the rod 41) relative to the door 10 to the position corresponding to the predetermined rotational position of the door 10, in a state where the engagement member (the rod 41) positioned at the position corresponding to the predetermined rotational position of the door 10 is caused to shift the position from the position corresponding to the predetermined rotational position of the door 10.

Upon the arrangement described herewith, when the operating portion CT is operated to operate the door 10 positioned at the full close position, the door 10 opens to the predetermined rotational position and retained at the predetermined rotational position. Accordingly, the door 10 is restrained from hitting an obstacle positioned at a position in the vehicle exterior direction when the door 10 opens by an unintentionally large amount by inertia at a time at which the door 10 is operated to open.

According to another aspect of this disclosure, the door opening mechanism (the door check mechanism 40, the driving portion 50) of the door actuating apparatus 20 pushes an end portion of the engagement member (the rod 41) configured to rotate the door 10 at the full close position to the predetermined rotational position positioned between the full close position and the full open position.

Upon the arrangement described herewith, the door opening mechanism (the door check mechanism 40, a driving portion 50) releases the door 10 from being retained when the operating portion CT, for example, a switch arranged on a portable device or on a vehicle, is operated to operate the door 10 at the full close position. In other words, a state of the engagement mechanism (the latch mechanism 30) switches from the engaged state to the disengaged state. At the same time, the actuator (the drive mechanism 70) actuates the door 10 and the door 10 automatically opens to the predetermined rotational position. As a result, an operational force at a beginning of opening the door 10 is small.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door actuating apparatus comprising:

an engagement mechanism selectively achieving an engaged state and a disengaged state, the engagement mechanism configured to achieve the engaged state where a door that is rotatably supported by a vehicle body is retained at a full close position, the engagement mechanism configured to achieve the disengaged state where the door is not retained at the full close position;

an operating portion configured to be operated for rotating the door that is at the full close position outward relative to a vehicle interior, the operating portion outputting a signal for rotating the door;

a control unit receiving the signal from the operating portion, the control unit actuating an actuator in response to the signal;

an engagement member configured to be retained by the vehicle body and configured to engage with the door, the engagement member advancing and retracting relative to the door in accordance with rotation of the door; and a lever mechanism operated by actuation of the actuator, the lever mechanism shifting a state of the engagement mechanism from the engaged state to the disengaged state by virtue of the lever mechanism engaging the engagement mechanism while the engagement mechanism is in the engaged state, the lever mechanism engaging the engagement member to apply a force from the actuator to the door that rotates the door from the full close position to a predetermined rotational position positioned between the full close position and a full open position, the lever mechanism being separable from the engagement member to allow the door, when the door is in the predetermined rotational position, to rotate in a vehicle exterior direction when an external force rotating the door in the vehicle exterior direction is exerted on the door.

2. The door actuating apparatus according to claim 1, wherein the lever mechanism engages with the engagement member after the lever mechanism shifts the state of the engagement mechanism from the engaged state to the disengaged state by engaging with the engagement mechanism in the engaged state and is configured to rotate the door from the full close position to the predetermined rotational position.

3. The door actuating apparatus according to claim 1, wherein the lever mechanism includes a first driven member moving in accordance with an actuated position of the actuator, a second driven member driven by the first driven member, the second driven member engaging with the engagement mechanism, and a third driven member driven by the first driven member, the third driven member engaging with the engagement member, and wherein the lever mechanism, in a process where the actuated position of the actuator shifts in one direction from a position corresponding to the full close position of the door, shifts the state of the engagement mechanism in the engaged state to the disengaged state by the second driven member pushing an engaging portion of the engagement mechanism in a state where the actuated position of the actuator shifts from a first position to a second position positioned at a position in the one direction relative to the first position, moves position of the engagement member relative to the door from a position corresponding to the full close position of the door to a position corresponding to the predetermined rotational position by the third driven member pushing an engagement portion of the engagement member in a state where the actuated position of the actuator is at the second position or in a state where the actuated position of the actuator shifts from a third position positioned at a position in the one direction relative to the second position to a fourth position positioned at a position in the one direction relative to the third position, retains a state of the engagement mechanism in the disengaged state in a state where the actuated position of the actuator is at a position in the one direction relative to the second position, and configured to allow the door to rotate in the vehicle exterior direction relative to the predetermined rotational position of the door corresponding to the actuated position of the actuator by the engagement portion of the engagement member separating from the third driven member in a state where the external force rotating the door in the vehicle exterior direction is exerted on the door in a case where the engagement mechanism is in the disengaged state.

4. The door actuating apparatus according to claim 1, further comprising:

a limiter mechanism blocking a force in accordance with an external force from the engagement member to the lever mechanism in a state where an external force rotating the door in a vehicle interior direction is exerted on the door in a case where the engagement mechanism is in the disengaged state.

5. The door actuating apparatus according to claim 1, further comprising:

a retaining mechanism retaining the engagement member, the retaining mechanism configured to retain the engagement member on the door at a position corresponding to the predetermined rotational position of the door.

6. The door actuating apparatus according to claim 1, further comprising:

a biasing mechanism exerting a force on the engagement member, the force being in a direction to restore a position of the engagement member relative to the door to a position corresponding to the predetermined rotational position of the door, in a state where the engagement member is at the position corresponding to the predetermined rotational position of the door and the engagement member is caused to move away from the position corresponding to the predetermined rotational position of the door.

7. The door actuating apparatus according to claim 1, wherein the lever mechanism pushes an end portion of the engagement member to rotate the door at the full close position to the predetermined rotational position.

8. The door actuating apparatus according to claim 1, wherein the engagement mechanism comprises a latch and a pawl, the latch being rotatable and the pawl being configured to contact the latch to prevent the latch from rotating when the engagement mechanism is in the engaged state.

9. The door actuating apparatus according to claim 1, further comprising:

a retaining mechanism retaining the engagement member, the retaining mechanism configured to retain the engagement member on the door at a position corresponding to the predetermined rotational position of the door, and wherein the retaining mechanism comprises a biasing mechanism exerting a force on the engagement member in a direction to restore a position of the engagement member relative to the door to a position corresponding to the predetermined rotational position of the door when the engagement member is at the position corresponding to the predetermined rotational position of the door and the engagement member is caused to move away from the position corresponding to the predetermined rotational position of the door.

10. A door actuating apparatus comprising:

an engagement mechanism selectively achieving an engaged state and a disengaged state, the engagement mechanism configured to achieve the engaged state where a door that is rotatably supported by a vehicle body is retained at a full close position, the engagement mechanism configured to achieve the disengaged state where the door is not retained at the full close position;

an operating portion configured to be operated for rotating the door that is at the full close position outward relative to a vehicle interior, the operating portion outputting a signal for rotating the door;

a control unit receiving the signal from the operating portion, the control unit actuating an actuator in response to the signal;

an engagement member configured to be retained by the vehicle body and configured to engage with the door, the engagement member advancing and retracting relative to the door in accordance with rotation of the door; and a lever mechanism operating by actuation of the actuator, the lever mechanism shifting a state of the engagement mechanism from the engaged state to the disengaged state by virtue of the lever mechanism engaging the engagement mechanism while the engagement mechanism is in the engaged state, the lever mechanism engaging the engagement member to rotate the door from the full close position to a predetermined rotational position positioned between the full close position and a full open position, the lever mechanism being separable from the engagement member to allow the door, when the door is in the predetermined rotational position, to rotate in a vehicle exterior direction when an external force rotating the door in the vehicle exterior direction is exerted on the door, wherein the lever mechanism includes a first driven member moving in accordance with an actuated position of the actuator, a second driven member driven by the first driven member, the second driven member engaging with the engagement mechanism, and a third driven member driven by the first driven member, the third driven member engaging with the engagement member, and wherein the lever mechanism, in a process where the actuated position of the actuator shifts in one direction from a position corresponding to the full close position of the door, shifts the state of the engagement mechanism in the engaged state to the disengaged state by the second driven member pushing an engaging portion of the engagement mechanism in a state where the actuated position of the actuator shifts from a first position to a second position positioned at a position in the one direction relative to the first position, moves position of the engagement member relative to the door from a position corresponding to the full close position of the door to a position corresponding to the predetermined rotational position by the third driven member pushing an engagement portion of the engagement member in a state where the actuated position of the actuator is at the second position or in a state where the actuated position of the actuator shifts from a third position positioned at a position in the one direction relative to the second position to a fourth position positioned at a position in the one direction relative to the third position, retains a state of the engagement mechanism in the disengaged state in a state where the actuated position of the actuator is at a position in the one direction relative to the second position, and configured to allow the door to rotate in the vehicle exterior direction relative to the rotational position of the door corresponding to the actuated position of the actuator by the engagement portion of the engagement member separating from the third driven member in a state where the external force rotating the door in the vehicle exterior direction is exerted on the door in a case where the engagement mechanism is in the disengaged state.

11. A door actuating apparatus comprising:

an engagement mechanism selectively achieving an engaged state and a disengaged state, the engagement mechanism configured to achieve the engaged state where a door that is rotatably supported by a vehicle body is retained at a full close position, the engagement mechanism configured to achieve the disengaged state where the door is not retained at the full close position;

an operating portion configured to be operated for rotating the door that is at the full close position outward relative to a vehicle interior, the operating portion outputting a signal for rotating the door;

a control unit receiving the signal from the operating portion, the control unit actuating an actuator in response to the signal;

an engagement member configured to be retained by the vehicle body and configured to engage with the door, the engagement member advancing and retracting relative to the door in accordance with rotation of the door; and a lever mechanism operating by actuation of the actuator, the lever mechanism shifting a state of the engagement mechanism from the engaged state to the disengaged state by virtue of the lever mechanism engaging the engagement mechanism while the engagement mechanism is in the engaged state, the lever mechanism engaging the engagement member to rotate the door from the full close position to a predetermined rotational position positioned between the full close position and a full open position, the lever mechanism being separable from the engagement member to allow the door, when the door is in the predetermined rotational position, to rotate in a vehicle exterior direction when an external force rotating the door in the vehicle exterior direction is exerted on the door, further comprising a limiter mechanism blocking a force in accordance with an external force from the engagement member to the lever mechanism in a state where an external force rotating the door in a vehicle interior direction is exerted on the door in a case where the engagement mechanism is in the disengaged state.

* * * * *